US006565354B2

(12) United States Patent
Liang

(10) Patent No.: US 6,565,354 B2
(45) Date of Patent: May 20, 2003

(54) SAFETY ELECTRONIC LIGHTER

(76) Inventor: Chung-Ho Liang, 2/F., No. 66, Sec. 3, Cheng-Tai Rd., Wu-Ku Village, Taipei County (TW)

( * ) Notice: Subject to any disclaimer, the term of this patent is extended or adjusted under 35 U.S.C. 154(b) by 0 days.

(21) Appl. No.: 09/915,320

(22) Filed: Jul. 27, 2001

(65) Prior Publication Data

US 2003/0022120 A1 Jan. 30, 2003

(51) Int. Cl.[7] ..... F23Q 2/28
(52) U.S. Cl. ..... 431/153; 431/255
(58) Field of Search ..... 431/153, 255

(56) References Cited

U.S. PATENT DOCUMENTS 6,012,916 A * 1/2000 Liang ..... 431/153
6,126,437 A * 10/2000 Lixiang et al. ..... 431/153
6,244,858 B1 * 6/2001 Wang ..... 431/153

* cited by examiner

*Primary Examiner*—Sara Clarke
(74) *Attorney, Agent, or Firm*—Rosenberg, Klein & Lee

(57) ABSTRACT

A safety electronic lighter includes an ignition control switch, which is operated to drive a high voltage coil, causing it to discharge a high voltage in producing sparks, the ignition control switch being rotatable between the operative position and the non-operative position, a safety lock, which is operated to lock the ignition control switch, prohibiting the ignition control switch from operation, a first power control switch, which is operated to switch on/off the power supply circuit of the electronic lighter, a second power control switch adapted to control the operation of the first power control switch and being rotated between the operative position and the non-operative position.

1 Claim, 5 Drawing Sheets

SAFETY ELECTRONIC LIGHTER

BACKGROUND OF THE INVENTION

The present invention relates to electronic lighters, and more particularly to a safety electronic lighter, which uses two power control switches to double-lock the ignition switch, preventing actuation of the ignition switch accidentally.

U.S. Pat. No. 6,012,916 discloses a safety electronic lighter, which comprises an ignition control switch, which is operated to drive a high voltage coil, causing it to discharge sparks, the ignition control switch being rotatable between the operative position and the non-operative position, a safety lock, which is operated to lock the ignition control switch, preventing the ignition control switch from operation, a first power control switch, which is operated to switch on/off the power supply circuit of the electronic lighter, a second power control switch connected in series to the first power control switch, the second power control switch being mounted inside the housing of the electronic lighter and kept from sight and accessible by a rod member through a hole at the housing of the electronic lighter. This structure of electronic lighter is functional, and safe in use.

SUMMARY OF THE INVENTION

The present invention is based on the aforesaid safety electronic lighter. According to one aspect of the present invention, the safety electronic lighter comprises an ignition control switch, which is operated to drive a high voltage coil, causing it to discharge a high voltage in producing sparks, the ignition control switch being rotatable between the operative position and the non-operative position, a safety lock, which is operated to lock the ignition control switch, prohibiting the ignition control switch from operation, a first power control switch, which is operated to switch on/off the power supply circuit of the electronic lighter, a second power control switch adapted to control the operation of the first power control switch and being rotated between the operative position and the non-operative position. According to another aspect of the present invention, the second power control switch is rotatable between the operative position.

DETAILED DESCRIPTION OF THE PREFERRED EMBODIMENT

Figure 1:
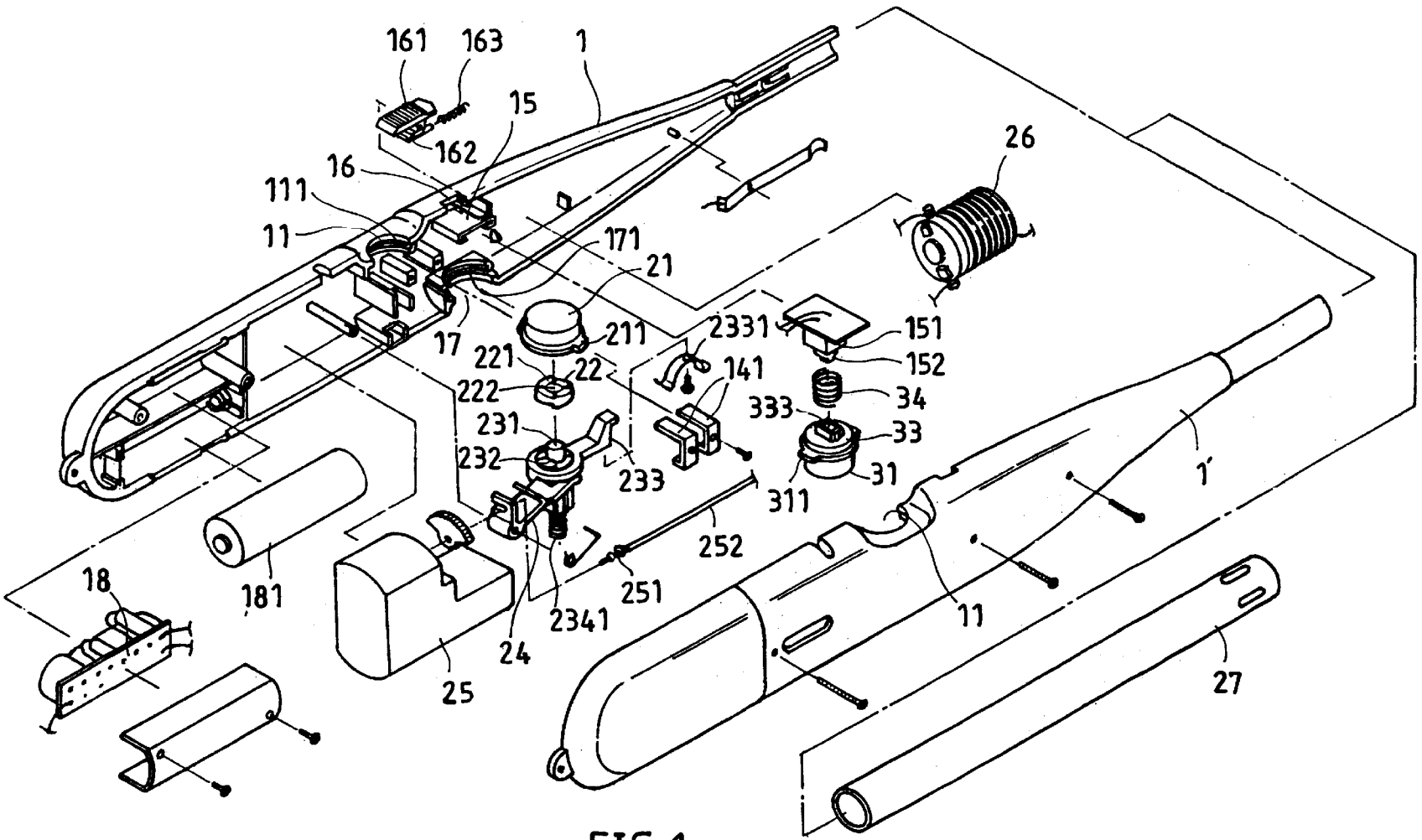
FIG. 1 is an exploded view of a safety electronic lighter according to the present invention.
Figure 2:
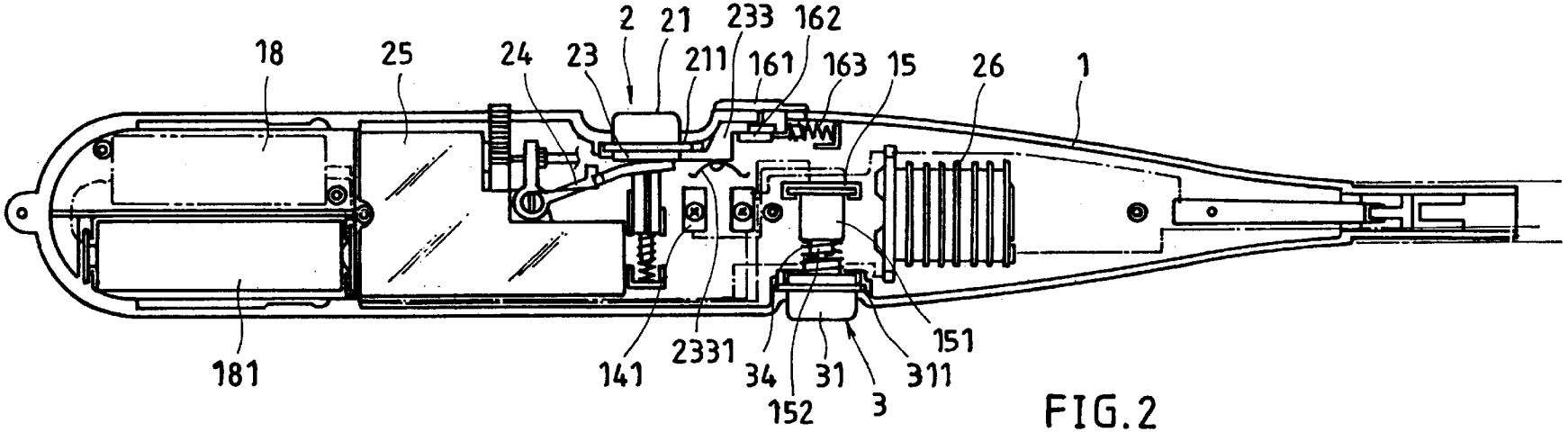
FIG. 2 is a sectional assembly view of the safety electronic lighter according to the present invention.
Figure 4:
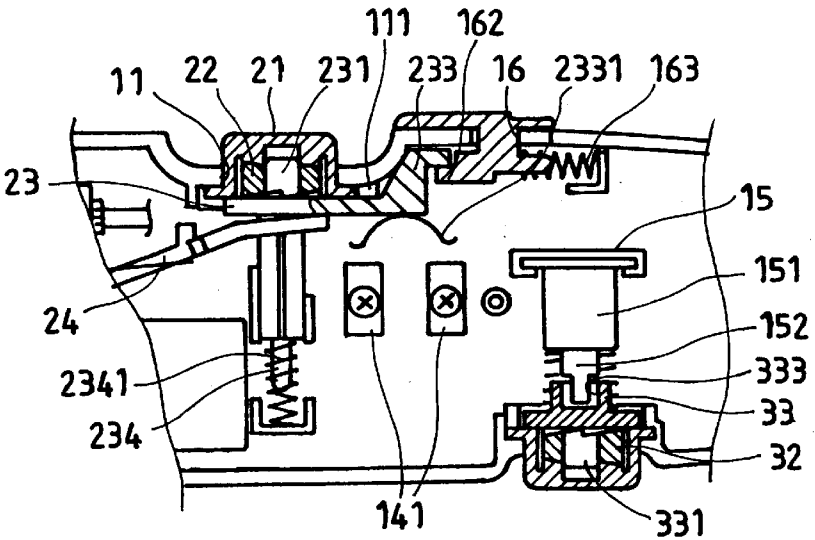
FIG. 4 is a sectional assembly view of a part of FIG. 3.
Figure 3:
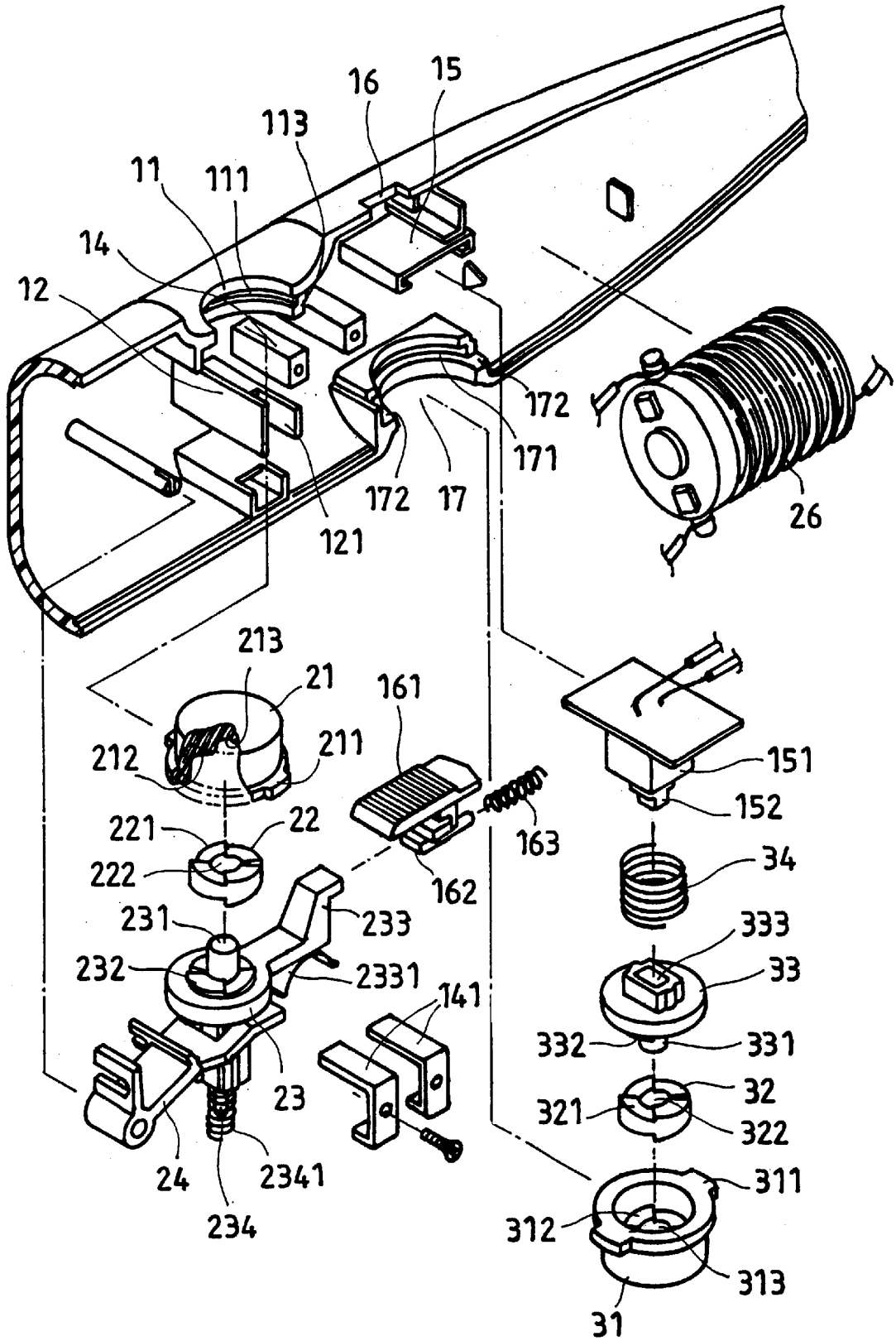
FIG. 3 is an exploded view in an enlarged scale of a part of the present invention, showing the arrangement of the ignition control switch, the safety lock, and the power control switch.

Referring to FIGS. from 1 through 4, a safety electronic lighter in accordance with the present invention is generally comprised of a housing, which is formed of two outer shells 1 and 1', and an ignition control switch 2 mounted in a hole 11 on the middle of the top side of the housing of the outer shells 1 and 1'. The ignition control switch 2 is comprised of a control knob 21, a driving element 22, and a control bar 23. The control bar 23 is mounted in an opening 121 at a projecting frame 12 at one outer shell 1, having a bottom pin 234 downwardly extended from its bottom, a top pin 231 raised from its top, a plurality of bevel steps 232 at its top side around the root of the top pin 231, an extension 233, and a metal strip 2331 at the end of the extension 233. A spring 2341 is mounted on a substantially U-shaped holder plate 13 at one outer shell 1 around the bottom pin 234 below the projecting frame 12. The spring 2341 supports the control bar 23 on the holder plate 13. The driving element 22 comprises a center hole 222, which receives the top pin 231 of the control bar 23, and two sets of bevel steps 221 respectively disposed at its top and bottom sides around the center hole 222. The bevel steps 221 at the bottom side of the driving element 22 are meshed with the bevel steps 232 at the control bar 23. The control knob 21 is covered on a part of the control bar 23, having a bottom chamber 213, which receives the driving element 22, a plurality of bevel steps 212 disposed inside the bottom chamber 213 and meshed with the bevel steps 221 at the top side of the driving element 22, and two projecting rods 211 raised from the periphery at two opposite sides and respectively inserted in respective grooves 111 at the bottom side of the hole 11 for enabling the control knob 21 to be rotated clockwise/counter-clockwise within 90° angle. Stop strips 112 are provided in the grooves 111 to limit the angle of rotation of the control knob 21 within 90° angles, i.e., the control knob 21 is permitted to rotate through 90° angles in clockwise as well as counter-clockwise direction (see also FIGS. from 6A through 6C). Two metal contacts 141 are respectively mounted on a respective lug 14 at one outer shell, namely, the left outer shell 1, and connected to power supply by a respective conductor. When the ignition control switch 2 is pressed down, the metal strip 2331 is forced into contact with the metal contacts 141, thereby causing the electric circuit to be closed. On the contrary, when the ignition control switch 2 is released, the control bar 23 is pushed upwardly back to its former position, and the metal strip 2331 is moved with the control bar 23 from the metal contacts 141 to disconnect the electric circuit.

A safety lock 161 is slidably mounted in a sliding slot 16 in one outer shell, namely, the left outer shell 1 of the housing and supported on a spring 163 inside the left outer shell 1, having a bottom stop strip 162. The spring 163 imparts a forward pressure to the safety lock 161. Due to the effect of the spring power of the spring 163, the safety lock 161 is normally held in the locking position where the bottom stop strip 162 is stopped against the rear end of the extension 233 of the control bar 23, preventing the control bar 23 from downward movement. Therefore, the safety lock 161 must be moved backwards from the extension 233 of the control bar 23 to compress the spring 163 before switching on the ignition control switch 2.

A high-voltage coil 26 is provided in the housing of the outer shells 1 and 1' near the front side, and connected to a high-voltage generating circuit 18 and a battery 181. The high-voltage generating circuit 18 controls the high-voltage coil 26 to discharge a high voltage in producing sparks for igniting fuel gas. A press-button switch 151 is mounted in a switch holder 15 at one outer shell 1, and operated to close/open the circuit of the high voltage coil 26, the high-voltage generating circuit 18 and the battery 181.

A hole 17 is provided in the housing of the outer shells 1;1'. An annular groove 171 is provided in the inside wall of the housing of the outer shells 1;1' around the hole 17. Two notches 172 are provided in the annular groove 171 at two sides. A power control switch 3 is installed in the hole 17, and adapted to control the operation of the press-button switch 151. The power control switch 3 is comprised of a control knob 31, a driving element 32, a follower block 33, and a compression spring 34. The control knob 31 comprises a bottom chamber 313, which receives the driving element 32, a plurality of bevel steps 312 disposed inside the bottom chamber 313 and meshed with respective top bevel steps 321 of the driving element 32, and two projecting rods 311 raised from the periphery at two opposite sides and respectively inserted in the annular groove 171 for enabling the control knob 31 to be rotated clockwise/counter-clockwise within 90° angle. The follower block 33 comprises a rectangular coupling hole 333 coupled to the rectangular button 152 of the press-button switch 151, a top pin 331 inserted into the center hole 322 of the driving element 32, and a plurality of bevel steps 332 disposed around the top pin 331 and meshed with respective bottom bevel steps 321 of the driving element 32. When rotating the control knob 31 through 90 angles, the projecting rods 311 are engaged into the annular groove 171 to stop the control knob 31 from axial movement, and therefore the user cannot depress the control knob 31 to switch on the press-button switch 151.

Figure 5:
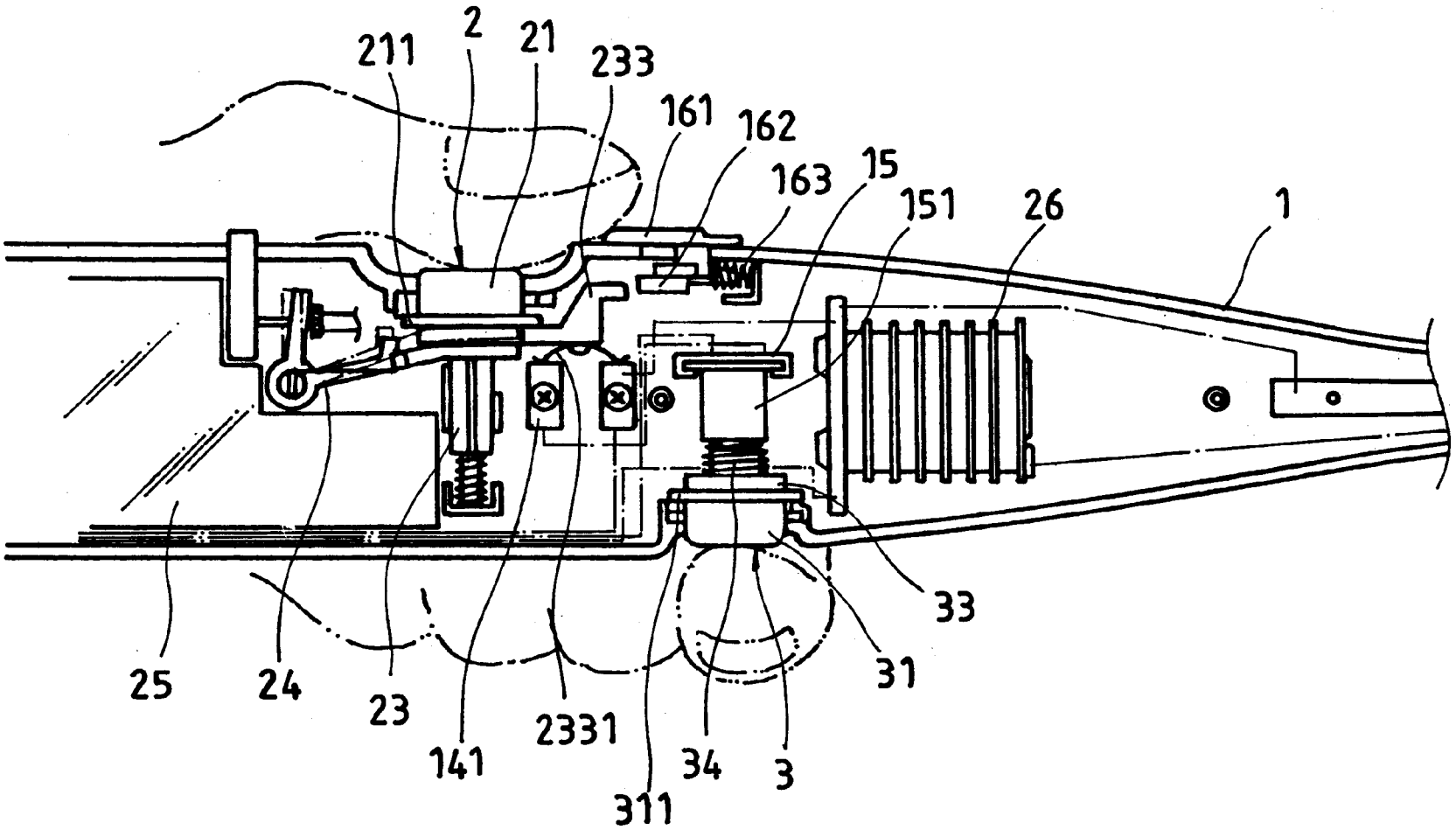
FIG. 5 is a sectional view showing the operation of the present invention.
Figure 6C:
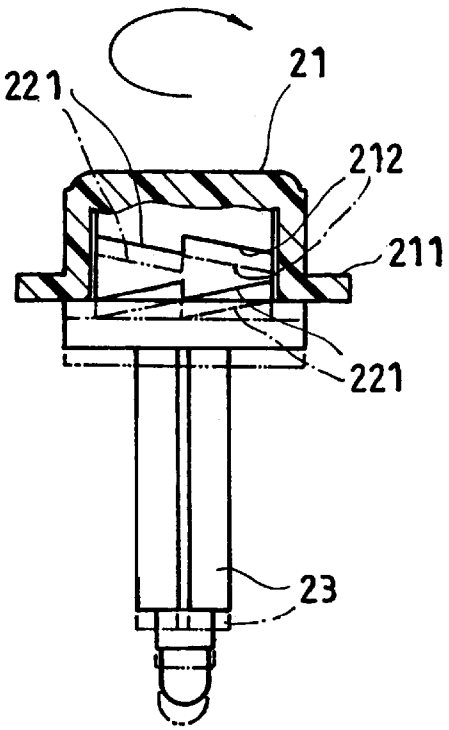
FIG. 6C is a schematic drawing showing the control knob rotated clockwise according to the present invention.
Figure 6B:
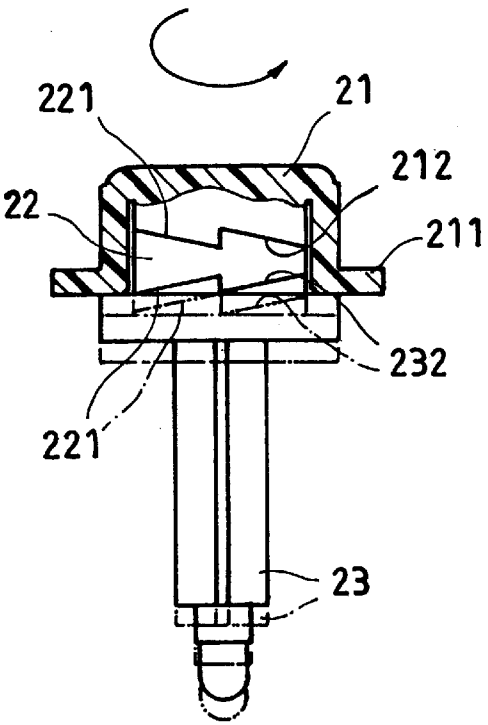
FIG. 6B is a schematic drawing showing the control knob rotated counter-clockwise according to the present invention.
Figure 6A:
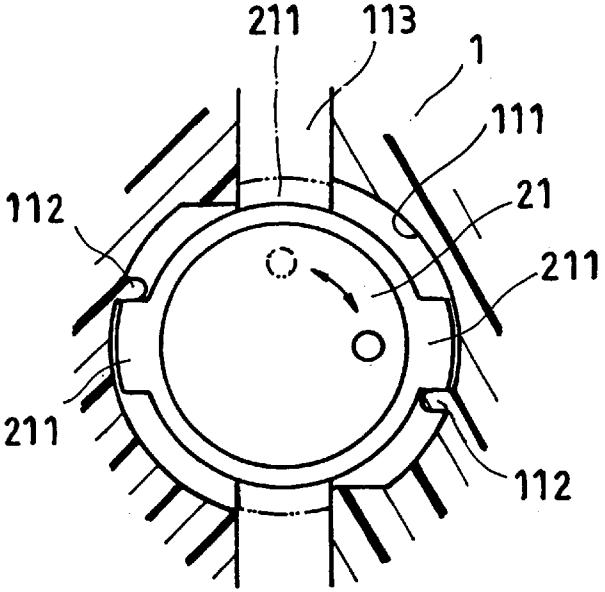
FIG. 6A is a sectional view of a part of the present invention showing the positioning of the control knob in the housing.

Referring to FIG. 5, when in use, the control knob 21 of the ignition control switch 2 and the control knob 31 of the power control switch 3 must be respectively rotated to such a position that the projecting rods 211;311 are respectively moved to the respective notches 113;172 and the safety lock 161 must be pushed away from the extension 233 of the control bar 23, so that the control knobs 21;31 can be simultaneously depressed to switch on the ignition control switch 2 and the press-button switch 151. After depressing of the ignition control switch 2 and the press-button switch 151, the pull rod 24 is pulled to open the valve 251 of the gas tank 25 for enabling fuel gas to flow through the gas tube 252 to the flame tube 27 for burning by sparks producing due to discharge of a high voltage from the high-voltage coil 26.

It is to be understood that the drawings are designed for purposes of illustration only, and are not intended as a definition of the limits and scope of the invention disclosed.

What the invention claimed is:

1. A safety electronic lighter comprising:

a housing having a first opening formed in an upper side thereof and a second opening formed in a lower side of said housing, each of said first and second opening having a groove formed in a perimeter edge thereof, each said groove having a pair of bilaterally disposed notches formed therein;

a gas tank mounted in said housing in fluid communication with a flame tube for emitting a flame from said housing;

electrical power supply means for generating electrical sparks at one end of said flame tube, said electrical power supply means including a battery, a high voltage coil and a battery power supply circuit coupled to said battery;

an ignition control switch mounted in said housing and displaceable for electrical contact to said power supply means, said ignition control switch including (a) a first control knob disposed in said first opening of said housing and having a pair of bilaterally disposed projecting rods extending therefrom, said first control knob having a bottom chamber with bevel steps formed therein, (b) a first driving element disposed in said bottom chamber of said first control knob and having a plurality of bevel steps formed on top and bottom sides thereof, said bevel steps on said top side being engaged with said bevel steps within said bottom chamber of said first control knob, (c) a control bar having opposing top and bottom pins extending therefrom and a plurality of bevel steps surrounding said top pin, said first driving element being rotatably disposed on said top pin and said plurality of bevel steps on said bottom side of said first driving element being engaged with said plurality of bevel steps of said control bar, and (d) a spring disposed on said bottom pin for upwardly biasing said control bar, said first control knob being rotatable to displace said projecting rods within said groove to and from said notches; said first control knob being downwardly displaceable when said projecting rods are respectively disposed in said notches and blocked from downward displacement when said projecting rods are respectively disposed external to said notches; and a power control switch mounted in said housing at a location remote from said ignition control switch and electrically coupled to said electrical power supply means, said power control switch including (a) a second control knob disposed in said second opening of said housing and having a pair of bilaterally disposed projecting rods extending therefrom, said second control knob having a bottom chamber with bevel steps formed therein, (b) a second driving element disposed in said bottom chamber of said second control knob and having a plurality of bevel steps formed on top and bottom sides thereof, said bevel steps on said bottom side being engaged with said bevel steps within said bottom chamber of said second control knob, (c) a follower block having opposing top and bottom sides with a pin extending from said bottom side of said follower block and a plurality of bevel steps surrounding said pin, said second driving element being rotatably disposed on said pin and said plurality of bevel steps on said top side of said second driving element being engaged with said plurality of bevel steps of said follower block, (d) a push-button switch having an operating button coupled to said follower block, and (e) a spring disposed between said push-button switch and said follower block for downwardly biasing said follower block and said second control knob therewith, said second control knob being rotatable to displace said projecting rods thereof within said groove of said second opening to and from said notches respectively formed therein, said second control knob being upwardly displaceable when said projecting rods thereof are correspondingly disposed in said respective notches and blocked from upward displacement when said projecting rods are disposed external to said respective notches, whereby simultaneous actuation of said ignition control switch and said first power control switch discharges said electrical sparks.

* * * * *